US008082071B2

(12) United States Patent
Daum et al.

(10) Patent No.: US 8,082,071 B2
(45) Date of Patent: Dec. 20, 2011

(54) SYSTEM AND METHOD OF MULTI-GENERATION POSITIVE TRAIN CONTROL SYSTEM

(75) Inventors: Wolfgang Daum, Erie, PA (US); John Hershey, Ballston Lake, NY (US); Randall Markley, Melbourne, FL (US); Paul Julich, Indialantic, FL (US); Mitchell Scott Wills, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 1177 days.

(21) Appl. No.: 11/518,250

(22) Filed: Sep. 11, 2006

(65) Prior Publication Data

US 2008/0065282 A1 Mar. 13, 2008

(51) Int. Cl.
*G06F 7/00* (2006.01)
*G08G 1/00* (2006.01)
*G01C 21/00* (2006.01)

(52) U.S. Cl. ..... 701/19; 701/1; 701/20; 701/117; 701/119; 701/200

(58) Field of Classification Search ..... 701/19, 701/20, 117; 246/187; 705/8
See application file for complete search history.

(56) References Cited

U.S. PATENT DOCUMENTS

| | | | |
|---|---|---|---|
| 3,575,594 | A | 4/1971 | Elcan |
| 3,734,433 | A | 5/1973 | Metzner |
| 3,794,834 | A | 2/1974 | Auer, Jr. et al. |
| 3,839,964 | A | 10/1974 | Gayot |
| 3,895,584 | A | 7/1975 | Paddison |
| 3,944,986 | A | 3/1976 | Staples |
| 4,099,707 | A | 7/1978 | Anderson |
| 4,122,523 | A | 10/1978 | Morse et al. |
| 4,361,300 | A | 11/1982 | Rush |
| 4,361,301 | A | 11/1982 | Rush |
| 4,610,206 | A | 9/1986 | Kubala et al. |
| 4,669,047 | A | 5/1987 | Chucta |
| 4,791,871 | A | 12/1988 | Mowll |
| 4,843,575 | A | 6/1989 | Crane |
| 4,883,245 | A | 11/1989 | Erickson, Jr. |
| 4,926,343 | A | 5/1990 | Tsuruta et al. |
| 4,937,743 | A | 6/1990 | Rassman et al. |
| 5,038,290 | A | 8/1991 | Minami |
| 5,063,506 | A | 11/1991 | Brockwell et al. |
| 5,177,684 | A | 1/1993 | Harker et al. |
| 5,222,192 | A | 6/1993 | Shafer |
| 5,229,948 | A | 7/1993 | Wei et al. |

(Continued)

FOREIGN PATENT DOCUMENTS

| | | |
|---|---|---|
| CA | 2057039 | 12/1990 |

(Continued)

OTHER PUBLICATIONS

Crone, et al., "Distributed Intelligent Network Management for the SDI Ground Network," IEEE, 1991, pp. 722-726, MILCOM '91.

(Continued)

*Primary Examiner* — Khoi Tran
*Assistant Examiner* — Ian Jen
(74) *Attorney, Agent, or Firm* — Duane Morris LLP

(57) ABSTRACT

A system and method of scheduling the movement of trains as a function of the predicted crew behavior and predicted rail conditions based on the historical behavior of the crew for specific rail conditions.

8 Claims, 4 Drawing Sheets

U.S. PATENT DOCUMENTS

| | | | | |
|---|---|---|---|---|
| 5,237,497 | A | 8/1993 | Sitarski | |
| 5,265,006 | A | 11/1993 | Asthana et al. | |
| 5,289,563 | A | 2/1994 | Nomoto et al. | |
| 5,311,438 | A | 5/1994 | Sellers et al. | |
| 5,331,545 | A | 7/1994 | Yajima et al. | |
| 5,332,180 | A | 7/1994 | Peterson et al. | |
| 5,335,180 | A | 8/1994 | Takahashi et al. | |
| 5,365,516 | A | 11/1994 | Jandrell | |
| 5,390,880 | A | 2/1995 | Fukawa et al. | |
| 5,420,883 | A | 5/1995 | Swensen et al. | |
| 5,437,422 | A | 8/1995 | Newman | |
| 5,463,552 | A | 10/1995 | Wilson et al. | |
| 5,467,268 | A | 11/1995 | Sisley et al. | |
| 5,487,516 | A | 1/1996 | Murata et al. | |
| 5,541,848 | A | 7/1996 | McCormack et al. | |
| 5,623,413 | A | 4/1997 | Matheson et al. | |
| 5,745,735 | A | 4/1998 | Cohn et al. | |
| 5,794,172 | A | 8/1998 | Matheson et al. | |
| 5,823,481 | A | 10/1998 | Gottschlich | |
| 5,825,660 | A | 10/1998 | Cagan et al. | |
| 5,828,979 | A | 10/1998 | Polivka et al. | |
| 5,850,617 | A | 12/1998 | Libby | |
| 6,032,905 | A | 3/2000 | Haynie | |
| 6,115,700 | A | 9/2000 | Ferkinhoff et al. | |
| 6,125,311 | A * | 9/2000 | Lo | 701/29 |
| 6,144,901 | A | 11/2000 | Nickles et al. | |
| 6,154,735 | A | 11/2000 | Crone | |
| 6,250,590 | B1 | 6/2001 | Hofestadt et al. | |
| 6,351,697 | B1 | 2/2002 | Baker | |
| 6,377,877 | B1 | 4/2002 | Doner | |
| 6,393,362 | B1 | 5/2002 | Burns | |
| 6,405,186 | B1 | 6/2002 | Fabre et al. | |
| 6,459,965 | B1 | 10/2002 | Polivka et al. | |
| 6,587,764 | B2 | 7/2003 | Nickles et al. | |
| 6,637,703 | B2 | 10/2003 | Matheson et al. | |
| 6,654,682 | B2 | 11/2003 | Kane et al. | |
| 6,766,228 | B2 | 7/2004 | Chirescu | |
| 6,789,005 | B2 | 9/2004 | Hawthorne | |
| 6,799,097 | B2 | 9/2004 | Villarreal Antelo | |
| 6,799,100 | B2 | 9/2004 | Burns | |
| 6,853,889 | B2 * | 2/2005 | Cole | 701/19 |
| 6,856,865 | B2 | 2/2005 | Hawthorne | |
| 7,006,796 | B1 * | 2/2006 | Hofmann et al. | 455/66.1 |
| 7,263,475 | B2 * | 8/2007 | Hawthorne et al. | 703/8 |
| 7,340,328 | B2 * | 3/2008 | Matheson et al. | 701/19 |
| 7,386,391 | B2 * | 6/2008 | Morariu et al. | 701/117 |
| 7,558,659 | B2 * | 7/2009 | Takamatsu et al. | 701/51 |
| 2001/0029411 | A1 * | 10/2001 | Hawthorne | 701/19 |
| 2003/0105561 | A1 | 6/2003 | Nickles et al. | |
| 2003/0183729 | A1 | 10/2003 | Root et al. | |
| 2004/0010432 | A1 | 1/2004 | Matheson et al. | |
| 2004/0034556 | A1 * | 2/2004 | Matheson et al. | 705/8 |
| 2004/0093196 | A1 * | 5/2004 | Hawthorne et al. | 703/8 |
| 2004/0093245 | A1 | 5/2004 | Matheson et al. | |
| 2004/0172175 | A1 * | 9/2004 | Julich et al. | 701/19 |
| 2004/0267415 | A1 | 12/2004 | Lacote et al. | |
| 2005/0107890 | A1 | 5/2005 | Minkowitz et al. | |
| 2005/0192720 | A1 | 9/2005 | Christie et al. | |
| 2006/0074544 | A1 * | 4/2006 | Morariu et al. | 701/117 |
| 2006/0195327 | A1 * | 8/2006 | Kumar et al. | 705/1 |
| 2008/0065282 | A1 * | 3/2008 | Daum et al. | 701/19 |

FOREIGN PATENT DOCUMENTS

| | | |
|---|---|---|
| CA | 2066739 | 2/1992 |
| CA | 2046984 | 6/1992 |
| CA | 2112302 | 6/1994 |
| CA | 2158355 | 10/1994 |
| EP | 0108363 | 5/1984 |
| EP | 0193207 | 9/1986 |
| EP | 0341826 | 11/1989 |
| EP | 0554983 | 8/1993 |
| FR | 2692542 | 12/1993 |
| GB | 1321053 | 6/1973 |
| GB | 1321054 | 6/1973 |
| JP | 3213459 | 9/1991 |
| WO | WO 90/03622 | 4/1990 |
| WO | WO 93/15946 | 8/1993 |

OTHER PUBLICATIONS

Ghedira, "Distributed Simulated Re-Annealing for Dynamic Constraint Satisfaction Problems," IEEE 1994, pp. 601-607.

Hasselfield, et al., "An Automated Method for Least Cost Distribution Planning," IEEE Transactions on Power Delivery, vol. 5, No. 2, Apr. 1990, 1188-1194.

Herault, et al., "Figure-Ground Discrimination: A Combinatorial Optimization Approach," IEEE Transactions on Pattern Analysis & Machine Intelligence, vol. 15, No. 9, Sep. 1993, 899-914.

Igarashi, "An Estimation of Parameters in an Energy Fen Used in a Simulated Annealing Method," IEEE, 1992, pp. IV-180-IV-485.

Komaya, "A New Simulation Method and its Application to Knowledge-based Systems for Railway Scheduling," May 1991, pp. 59-66.

Puget, "Object Oriented Constraint Programming for Transportation Problems," IEEE 1993, pp. 1-13.

Sasaki, et al., "Development for a New Electronic Blocking System," QR of RTRI, vol. 30, No. 4, Nov. 1989, pp. 198-201.

Scherer, et al., "Combinatorial Optimization for Spacecraft Scheduling," 1992 IEEE International Conference on Tolls with AI, Nov. 1992, pp. 120-126.

Watanabe, et al., "Moving Block System with Continuous Train Detection Utilizing Train Shunting Impedance of Track Circuit," QR of RTRI, vol. 30, No. 4, Nov. 1989, pp. 190-197.

* cited by examiner

SYSTEM AND METHOD OF MULTI-GENERATION POSITIVE TRAIN CONTROL SYSTEM

RELATED APPLICATIONS

The present application is related to the commonly owned U.S. patent application Ser. No. 11/415,273 entitled "Method of Planning Train Movement Using A Front End Cost Function", Filed May 2, 2006, and U.S. patent application Ser. No. 11/476,552 entitled "Method of Planning Train Movement Using A Three Step Optimization Engine", Filed Jun. 29, 2006, both of which are hereby incorporated herein by reference.

BACKGROUND OF THE INVENTION

The present invention relates to the scheduling the movement of plural trains through a rail network, and more specifically, to the scheduling of the movement of trains over a railroad system based on the predicted performance of the trains.

Systems and methods for scheduling the movement of trains over a rail network have been described in U.S. Pat. Nos. 6,154,735, 5,794,172, and 5,623,413, the disclosure of which is hereby incorporated by reference.

As disclosed in the referenced patents and applications, the complete disclosure of which is hereby incorporated herein by reference, railroads consist of three primary components (1) a rail infrastructure, including track, switches, a communications system and a control system; (2) rolling stock, including locomotives and cars; and, (3) personnel (or crew) that operate and maintain the railway. Generally, each of these components are employed by the use of a high level schedule which assigns people, locomotives, and cars to the various sections of track and allows them to move over that track in a manner that avoids collisions and permits the railway system to deliver goods to various destinations.

As disclosed in the referenced patents and applications, a precision control system includes the use of an optimizing scheduler that will schedule all aspects of the rail system, taking into account the laws of physics, the policies of the railroad, the work rules of the personnel, the actual contractual terms of the contracts to the various customers and any boundary conditions or constraints which govern the possible solution or schedule such as passenger traffic, hours of operation of some of the facilities, track maintenance, work rules, etc. The combination of boundary conditions together with a figure of merit for each activity will result in a schedule which maximizes some figure of merit such as overall system cost.

As disclosed in the referenced patents and applications, and upon determining a schedule, a movement plan may be created using the very fine grain structure necessary to actually control the movement of the train. Such fine grain structure may include assignment of personnel by name, as well as the assignment of specific locomotives by number, and may include the determination of the precise time or distance over time for the movement of the trains across the rail network and all the details of train handling, power levels, curves, grades, track topography, wind and weather conditions. This movement plan may be used to guide the manual dispatching of trains and controlling of track forces, or may be provided to the locomotives so that it can be implemented by the engineer or automatically by switchable actuation on the locomotive.

The planning system is hierarchical in nature in which the problem is abstracted to a relatively high level for the initial optimization process, and then the resulting course solution is mapped to a less abstract lower level for further optimization. Statistical processing is used at all levels to minimize the total computational load, making the overall process computationally feasible to implement. An expert system is used as a manager over these processes, and the expert system is also the tool by which various boundary conditions and constraints for the solution set are established. The use of an expert system in this capacity permits the user to supply the rules to be placed in the solution process.

Currently, the movements of trains are typically controlled in a gross sense by a dispatcher, but the actual control of the train is left to the crew operating the train. Because compliance with the schedule is, in large part, the prerogative of the crew, it is difficult to maintain a very precise schedule. As a result it is estimated that the average utilization of these capital assets in the United States is less than 50%. If a better utilization of these capital assets can be attained, the overall cost effectiveness of the rail system will accordingly increase.

Another reason that the train schedules have not heretofore been very precise is that it has been difficult to account for the factors that affect the movement of trains when setting up a schedule. These difficulties include the complexities of including in the schedule the determination of the effects of physical limits of power and mass, speed limits, the limits due to the signaling system and the limits due to safe handling practices, which include those practices associated with applying power and braking in such a manner to avoid instability of the train structure and hence derailments. One factor that has been consistently overlooked in the scheduling of trains is the effect of the behavior of a specific crew on the performance of the movement of a train.

The present application is directed to planning the movement of trains based on the predicted performance of the trains as a function of the crew assigned to the train and the conditions of the railroad.

These and many other objects and advantages of the present disclosure will be readily apparent to one skilled in the art to which the disclosure pertains from a perusal of the claims, the appended drawings, and the following detailed description of the embodiments.

DETAILED DESCRIPTION

As railroad systems continue to evolve, efficiency demands will require that current dispatch protocols and methods be upgraded and optimized. It is expected that there will be a metamorphosis from a collection of territories governed by manual dispatch procedures to larger territories, and ultimately to a single all-encompassing territory, governed by an automated dispatch system.

At present, dispatchers control within a local territory. This practice recognizes the need for a dispatcher to possess local knowledge in performing dispatcher duties. As a result of this present structure, train dispatch is at best locally optimized. It is a byword in optimization theory that local optimization is almost invariably globally suboptimal. To move to fewer but wider dispatch territories would require significantly more data exchange and concomitantly much greater computational power in order to optimize a more nearly global scenario.

In one aspect of the present disclosure, in order to move forward in broadening and consolidating dispatch territories, it is desirable to identify and resolve exceptions at a centralized location or under a centralized authority. As the automation of dispatch control and exception handling progresses, the dispatch routines will be increasingly better tuned and fewer exceptions will arise. In another aspect, all rail traffic information, rail track information including rail track conditions, weather data, crew scheduling and availability information, is collected and territory tasks and their priorities across the broadened territory are merged, interleaved, melded, to produce a globally optimized list of tasks and their priorities.

Figure 1A:
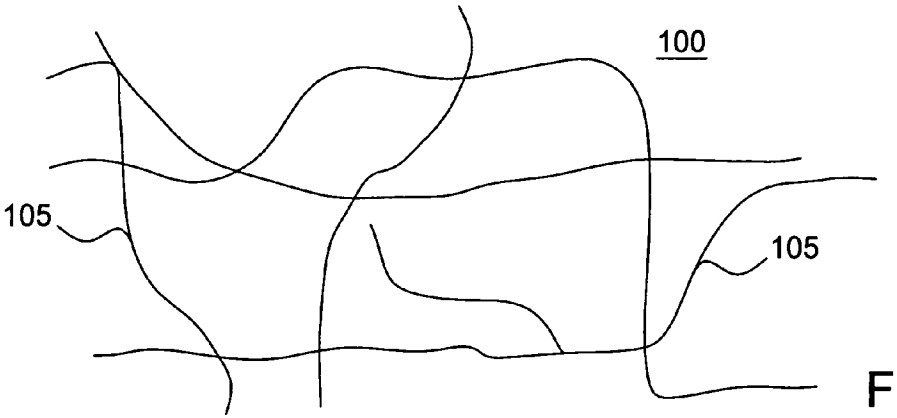
Fig. 1A PRIOR ART
FIG. 1A is a simplified pictorial representation of a prior art rail system.
Figure 1B:
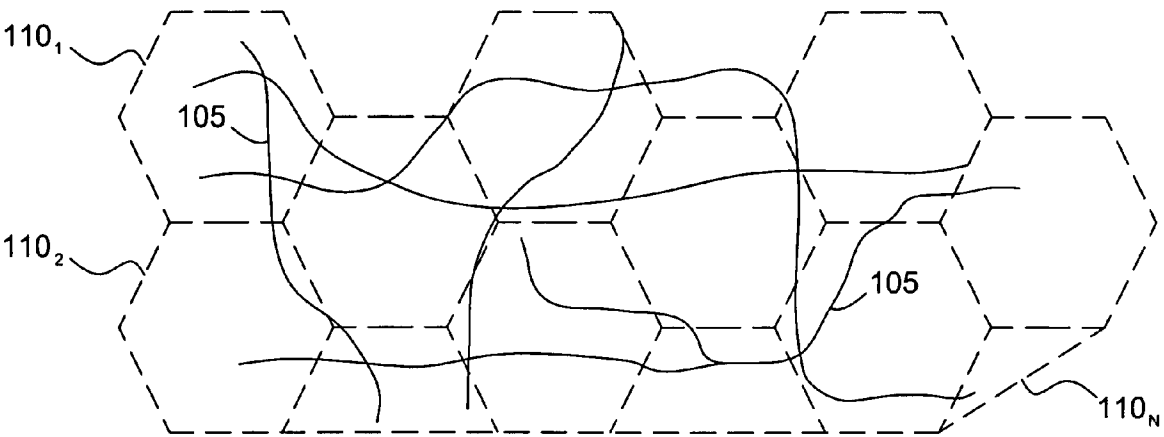
Fig. 1B PRIOR ART
FIG. 1B is a simplified pictorial representation of the rail system of FIG. 1A divided into dispatch territories.
Figure 2:
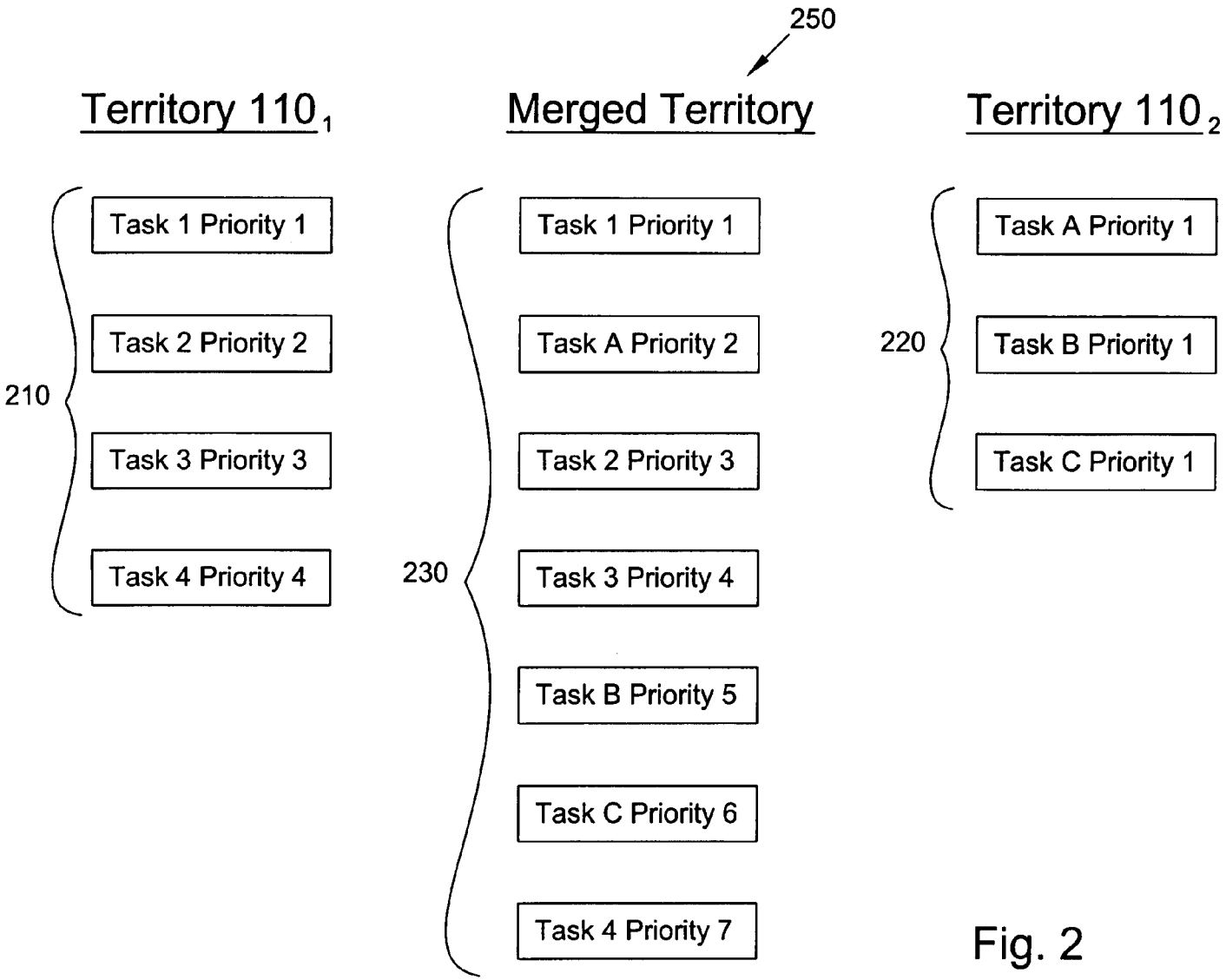
FIG. 2 is a simplified illustration of a merged task list for the combined dispatch territories of FIG. 1B.

FIG. 1A illustrates a global rail system 100 having a network of tracks 105. FIG. 1B represents the global rail system partitioned into a plurality of dispatch territories $\mathbf{110}_1$, $\mathbf{110}_2$ . . . $\mathbf{110}_N$. FIG. 2 represents one embodiment of the present disclosure wherein a prioritized task list is generated for combined dispatch territories $\mathbf{110}_1$ and $\mathbf{110}_2$. Territory $\mathbf{110}_1$ has a lists of tasks in priority order 210. Territory $\mathbf{110}_2$ has a list of tasks for its associated dispatch territory in priority order 220. The two territory task lists are merged to serve as the prioritized task list 230 for the larger merged territory of $\mathbf{110}_1$ and $\mathbf{110}_2$. The merging and assignment of relative priorities can be accomplished by a method identical or similar to the method used to prioritize the task list for the individual territories that are merged. For example, the prioritized task list can be generated using well known algorithms that optimize some parameter of the planned movement such as lowest cost or maximum throughput or maximum delay of a particular consist.

In another aspect of the present disclosure, the past behavior of a train crew can be used to more accurately predict train performance against the movement plan, which becomes a more important factor as dispatch territories are merged. Because the actual control of the train is left to the engineer operating the train, there will be late arrivals and in general a non-uniformity of behavior across train movements and the variance exhibited across engineer timeliness and other operational signatures may not be completely controllable and therefore must be presumed to persist. The individual engineer performances can reduce the dispatch system's efficiency on most territorial scales and certainly the loss of efficiency becomes more pronounced as the territories grow larger.

Figure 3A:
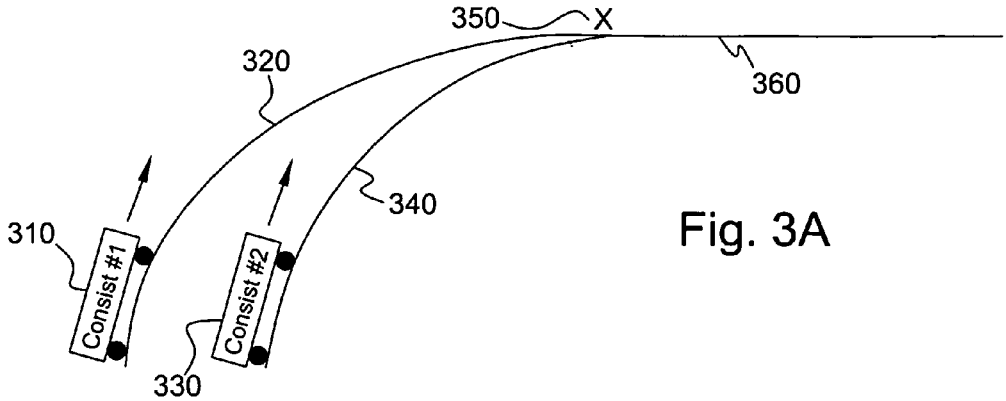
FIG. 3A is a simplified pictorial representation of two consists approaching a merged track.

In one embodiment, a behavioral model for each crew can be created using an associated transfer function that will predict the movements and positions of the trains controlled by that specific crew under the railroad conditions experienced at the time of prediction. The transfer function is crafted in order to reduce the variance of the effect of the different crews, thereby allowing better planning for anticipated delays and signature behaviors. The model data can be shared across territories and more efficient global planning will result. FIG. 3A is an example illustrating the use of behavioral models for crews operating consist #1 310 and consist #2 330. Consist #1 310 is on track 320 and proceeding to a track merge point 350 designated by an 'X' Consist #2 330 is on track 340 and is also proceeding towards the merge point 350. At the merge point 350 the two tracks 320 and 340 merge to the single track 360. The behavior of the two consists under control of their respective crews are modeled by their respective behavior models, which take into account the rail conditions at the time of the prediction. The rail conditions may be characterized by factors which may influence the movement of the trains including, other traffic, weather, time of day, seasonal variances, physical characteristics of the consists, repair, maintenance work, etc. Another factor which may be considered is the efficiency of the dispatcher based on the historical performance of the dispatcher in like conditions.

Figure 3B:
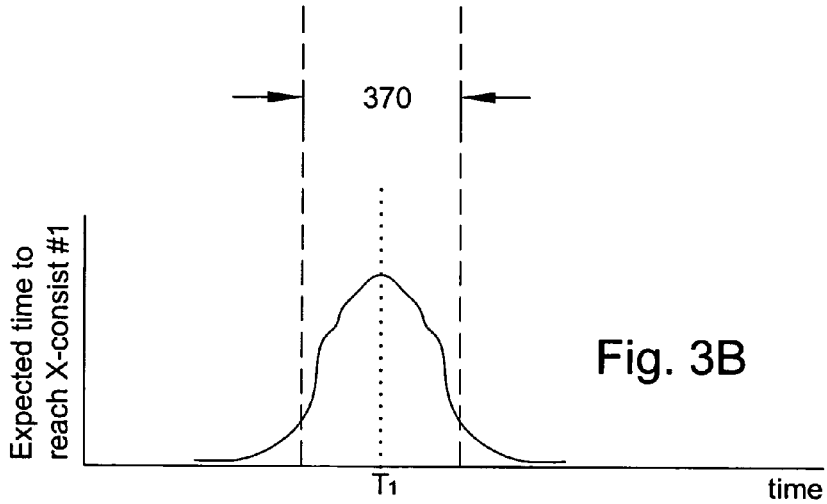
FIGS. 3B and 3C are simplified graphical representations of the predicted behavior of the consists from FIG. 3A in accordance with one embodiment of the present disclosure.
Figure 3C:
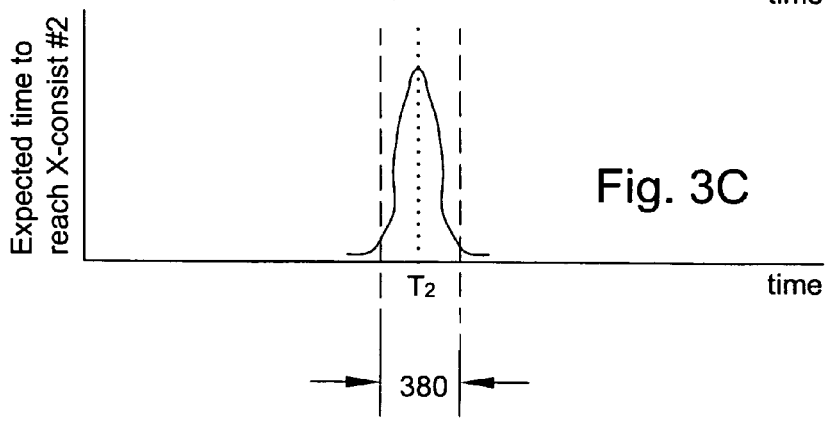

Using the behavior model for each consist, a graph of expected performance for each consist can be generated. FIG. 3B is a graph of the expected time of arrival of consist #1 310 at the merge point 350. FIG. 3 is a graph of the expected time of arrival of consist #2 330 at the merge point 350. Note that the expected arrival time for consist #1 is $T_1$ which is earlier than the expected arrival time at the merger point 350 for consist #2 which is $T_2$, that is $T_1<T_2$.

The variance of expected arrival time 370 for consist #1 310 is however much larger than the variance of expected arrival time 380 for consist #2 330 and therefore the railroad traffic optimizer may elect to delay consist #1 310 and allow consist #2 330 to precede it onto the merged track 360. Such a decision would be expected to delay operations for consist #1 310, but the delay may have nominal implications compared to the possibility of a significantly longer delay for both consists #1 310 and #2 330 should the decision be made to schedule consist #1 310 onto the merged track 360 ahead of consist #2 330. In prior art scheduling systems, the behavior of the crew was not taken into account, and in the present example, consist #1 310 would always be scheduled to precede consist #2 330 onto the merged track 360. Thus, by modeling each specific crew's behavior, important information can be collected and utilized to more precisely plan the movement of trains.

The behavior of a specific crew can be modeled as a function of the past performance of the crew. For example, a data base may be maintained that collects train performance information mapped to each individual member of a train crew. This performance data may also be mapped to the rail conditions that existed at the time of the train movement. This collected data can be analyzed to evaluate the past performance of a specific crew in the specified rail conditions and can be used to predict the future performance of the crew as a function of the predicted rail conditions. For example, it may be able to predict that crew A typically operates consist Y ahead of schedule for the predicted rail conditions, or more specifically when engineer X is operating consist Y, consist Y runs on average twelve minutes ahead of schedule for the predicted rail conditions.

Figure 4:
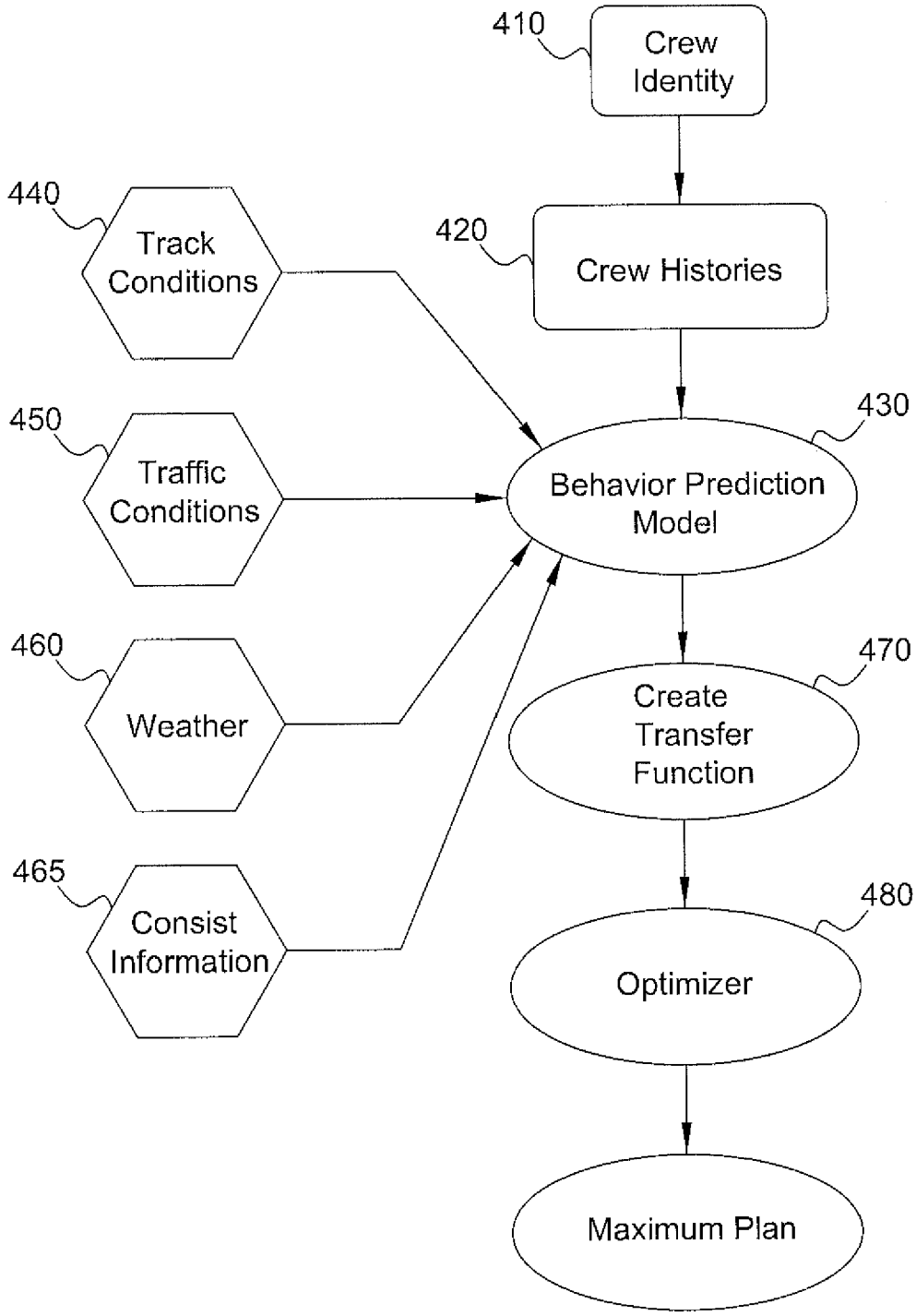
FIG. 4 is a simplified flow diagram of one embodiment of the present disclosure utilizing a behavior prediction model.

FIG. 4 illustrates one embodiment of the present disclosure for planning the movement of trains as a function of the behavior of the specific train crew. First the crew identity managing a particular consist is identified 410. This identity is input to the crew history database 420 or other storage medium or facility. The crew history database may contain information related to the past performance of individual crew members, as well as performance data for the combined individuals operating as a specific crew. The stored information may be repeatedly adjusted with each crew assignment to build a statistical database of crew performance. The crew history database 420 inputs the model coefficients for the particular crew model into the consist behavior prediction model 430. The model coefficients may be determined by historical parameters such as means and standard deviations of times required by a particular crew to travel standard distances at specific grades and measures of crew sensitivities to different and specific weather conditions. In one embodiment of the present disclosure, the model coefficients may be determined by statistical analysis using multivariant regression methods. Track condition information 440, track traffic conditions 450, weather conditions 460, and consist information 465, are also input to the behavior prediction model 430. The behavior prediction model 430 is run and its output is used to calculate a transfer function 470 that will supply the optimizer 480 with statistics respecting the expected behavior of the train such as its expected time to reach a rail point, the variance of the prediction, and other predicted data of interest. The optimizer 480 will be used to optimize the movement of the trains as a function of some objective function such as lowest cost, fewest exceptions, maximum throughput, minimum delay.

The embodiments disclosed herein for planning the movement of the trains can be implemented using computer usable medium having a computer readable code executed by special purpose or general purpose computers.

While embodiments of the present disclosure have been described, it is understood that the embodiments described are illustrative only and the scope of the disclosure is to be defined solely by the appended claims when accorded a full range of equivalence, many variations and modifications naturally occurring to those of skill in the art from a perusal hereof.

What is claimed:

1. A method of scheduling the movement of plural trains over a rail network, each train having an assigned crew to operate the train comprising the steps of:

(a) maintaining a database of information related to the past performance of the movement of a first train as a function of the crew assigned to operate the first train, including crew model coefficients determined by historical parameters;

(b) mapping the past performance of the movement of the first train to each individual member of the crew by creating an association between the movement of the first train and the crew responsible for moving the train;

(c) mapping the past performance of the movement of the first train to a rail condition that existed at the time of the train movement by creating an association between the movement of the first train and the rail condition that existed at the time of the train movement;

(d) storing the mapped past performance for the individual member of the crew and the rail conditions;

(e) predicting the future performance of an individual member of a crew for a specified rail condition as a function of the stored information;

(f) scheduling the movement of a second train as a function of the predicted future performance.

2. The method of claim 1, wherein the step of maintaining a database of information related to the past performance of the movement of a first train includes comparing the actual movement of the first train with the movement plan of the first train.

3. The method of claim 1 wherein the step of scheduling the movement includes:

(i) assigning a second crew to operate the second train;

(ii) predicting a behavior of the second crew as a function of the information maintained in the database;

(iii) predicting the performance of the movement of the second train as a function of the predicted behavior of the crew;

(iv) scheduling the second train as a function of the predicted performance.

4. The method of claim 1 further comprising the steps of predicting the performance of an assigned crew for a specific rail condition as a function of the stored data.

5. The method of claim 4 wherein the predicted performance includes an estimated variance of time of arrival.

6. The method of claim 1 wherein the performance includes an estimation of the time required by a specific crew to travel a specific distance.

7. The method of claim 1 wherein the performance includes a measure of crew sensitivities to specific weather conditions.

8. A system for scheduling the movement of plural trains over a rail network, each train having an assigned crew to operate the train comprising the steps of:

a database of information related to the past performance of the movement of a first train as a function of the crew assigned to operate the first train including crew model coefficients determined by historical parameters;

a computer program for the movement of trains, the computer program comprising:

a computer usable medium having computer readable program code modules embodied in said medium for scheduling trains;

a computer readable first program code module for mapping the past performance of the movement of the first train to each individual member of the crew by creating an association between the movement of the first train and the crew responsible for moving the train;

a computer readable second program code module for mapping the past performance of the movement of the first train to a rail condition that existed at the time of the train movement by creating an association between the movement of the first train and the rail condition that existed at the time of the train movement;

a computer readable third program code module for storing the mapped past performance for the individual member of the crew and the rail conditions;

a computer readable fourth program code module for predicting the future performance of an individual member of a crew for a specified rail condition as a function of the stored information; and a computer readable fifth program code module for scheduling the movement of a second train as a function of the predicted future performance.

* * * * *